US009353935B2

(12) United States Patent
Holland et al.

(10) Patent No.: US 9,353,935 B2
(45) Date of Patent: May 31, 2016

(54) ROTATABLE LIGHTING DEVICE

(71) Applicant: LIGHTING SCIENCE GROUP CORPORATION, Satellite Beach, FL (US)

(72) Inventors: Eric Holland, Indian Harbour Beach, FL (US); Mark Penley Boomgaarden, Satellite Beach, FL (US); Ricardo Romeu, Melbourne, FL (US)

(73) Assignee: Lighting Science Group, Corporation, Melbourne, FL (US)

( * ) Notice: Subject to any disclaimer, the term of this patent is extended or adjusted under 35 U.S.C. 154(b) by 20 days.

(21) Appl. No.: 13/792,986

(22) Filed: Mar. 11, 2013

(65) Prior Publication Data

US 2014/0254162 A1 Sep. 11, 2014

(51) Int. Cl.

| | |
|---|---|
| ***F21V 14/02*** | (2006.01) |
| ***F21V 21/30*** | (2006.01) |
| ***F21K 99/00*** | (2016.01) |
| ***F21V 21/15*** | (2006.01) |
| *F21Y 101/02* | (2006.01) |
| *F21Y 113/00* | (2016.01) |

(52) U.S. Cl.

CPC . *F21V 21/30* (2013.01); *F21K 9/13* (2013.01); *F21K 9/58* (2013.01); *F21V 21/15* (2013.01); *F21Y 2101/02* (2013.01); *F21Y 2113/00* (2013.01)

(58) Field of Classification Search

CPC ..... F21V 14/02; F21V 19/02; F21V 19/042; F21V 21/30; F21V 7/046; F21V 7/06–7/09

USPC ..... 362/249.02–249.03, 249.09–249.1, 362/429, 232, 249.07, 269, 275, 285, 287, 362/418, 419, 427, 800, 223, 224, 225, 226

See application file for complete search history.

(56) References Cited

U.S. PATENT DOCUMENTS

| | | | |
|---|---|---|---|
| 5,523,878 | A | 6/1996 | Wallace et al. |
| 5,597,233 | A | 1/1997 | Lau |
| 5,680,230 | A | 10/1997 | Kaburagi et al. |

(Continued)

FOREIGN PATENT DOCUMENTS

| | | |
|---|---|---|
| CN | 101 702 421 A | 5/2010 |
| EP | 1950491 | 7/2008 |

(Continued)

OTHER PUBLICATIONS

EP International Search Report for Application No. 10174449.8; (Dec. 14, 2010).

(Continued)

*Primary Examiner* — Evan Dzierzynski
*Assistant Examiner* — Zheng Song
(74) *Attorney, Agent, or Firm* — Mark Malek; Stephen Bullock; Widerman Malek, PL

(57) ABSTRACT

A lighting device includes an outer body having a base, a medial portion, and an upper portion. The lighting device may also include a light source carrying assembly to carry a light source and a lens. The light source carrying assembly may include an assembly base, an assembly top that pivotally engages a portion of the assembly base, and a heat sink. The light source carrying assembly may be configured to rotate about a first rotational axis and to pivot about a second rotational axis.

19 Claims, 7 Drawing Sheets

(56) References Cited

U.S. PATENT DOCUMENTS

| | | | | |
|---|---|---|---|---|
| 5,704,701 | A | 1/1998 | Kavanagh et al. | |
| 5,997,150 | A | 12/1999 | Anderson | |
| 6,140,646 | A | 10/2000 | Busta et al. | |
| 6,341,876 | B1 | 1/2002 | Moss et al. | |
| 6,356,700 | B1 | 3/2002 | Strobl | |
| 6,594,090 | B2 | 7/2003 | Kruschwitz et al. | |
| 6,767,111 | B1 | 7/2004 | Lai | |
| 6,817,735 | B2 | 11/2004 | Shimizu et al. | |
| 6,870,523 | B1 | 3/2005 | Ben-David et al. | |
| 6,871,982 | B2 | 3/2005 | Holman et al. | |
| 6,893,139 | B2 | 5/2005 | Cercone et al. | |
| 6,974,713 | B2 | 12/2005 | Patel et al. | |
| 7,072,096 | B2 | 7/2006 | Holman et al. | |
| 7,075,707 | B1 | 7/2006 | Rapaport et al. | |
| 7,083,304 | B2 | 8/2006 | Rhoads | |
| 7,178,941 | B2 | 2/2007 | Roberge et al. | |
| 7,246,923 | B2 | 7/2007 | Conner | |
| 7,255,469 | B2 | 8/2007 | Wheatley et al. | |
| 7,261,442 | B2 * | 8/2007 | Chiu | 362/372 |
| 7,261,453 | B2 | 8/2007 | Morejon et al. | |
| 7,289,090 | B2 | 10/2007 | Morgan | |
| 7,300,177 | B2 | 11/2007 | Conner | |
| 7,303,291 | B2 | 12/2007 | Ikeda et al. | |
| 7,303,327 | B2 * | 12/2007 | Copeland et al. | 362/640 |
| 7,325,956 | B2 | 2/2008 | Morejon et al. | |
| 7,342,658 | B2 | 3/2008 | Kowarz et al. | |
| 7,349,095 | B2 | 3/2008 | Kurosaki | |
| 7,400,439 | B2 | 7/2008 | Holman | |
| 7,429,983 | B2 | 9/2008 | Islam | |
| 7,434,946 | B2 | 10/2008 | Huibers | |
| 7,436,996 | B2 | 10/2008 | Ben-Chorin | |
| 7,438,443 | B2 | 10/2008 | Tatsuno et al. | |
| 7,476,016 | B2 | 1/2009 | Kurihara | |
| 7,520,642 | B2 | 4/2009 | Holman et al. | |
| 7,530,708 | B2 | 5/2009 | Park | |
| 7,540,616 | B2 | 6/2009 | Conner | |
| 7,556,406 | B2 | 7/2009 | Petroski et al. | |
| 7,598,686 | B2 | 10/2009 | Lys et al. | |
| 7,598,961 | B2 | 10/2009 | Higgins | |
| 7,626,755 | B2 | 12/2009 | Furuya et al. | |
| 7,670,021 | B2 | 3/2010 | Chou et al. | |
| 7,677,736 | B2 | 3/2010 | Kazasumi et al. | |
| 7,684,007 | B2 | 3/2010 | Hull et al. | |
| 7,703,943 | B2 | 4/2010 | Li et al. | |
| 7,705,810 | B2 | 4/2010 | Choi et al. | |
| 7,709,811 | B2 | 5/2010 | Conner | |
| 7,719,766 | B2 | 5/2010 | Grasser et al. | |
| 7,728,846 | B2 | 6/2010 | Higgins et al. | |
| 7,766,490 | B2 | 8/2010 | Harbers et al. | |
| 7,771,085 | B2 | 8/2010 | Kim | |
| 7,828,453 | B2 | 11/2010 | Tran et al. | |
| 7,832,878 | B2 | 11/2010 | Brukilacchio et al. | |
| 7,834,867 | B2 | 11/2010 | Sprague et al. | |
| 7,845,823 | B2 | 12/2010 | Mueller et al. | |
| 8,016,443 | B2 | 9/2011 | Falicoff et al. | |
| 8,047,660 | B2 | 11/2011 | Penn et al. | |
| 8,049,763 | B2 | 11/2011 | Kwak et al. | |
| 8,083,364 | B2 | 12/2011 | Allen | |
| 8,096,668 | B2 | 1/2012 | Abu-Ageel | |
| 8,132,943 | B2 | 3/2012 | Wang | |
| 8,172,436 | B2 | 5/2012 | Coleman et al. | |
| 8,201,968 | B2 | 6/2012 | Maxik et al. | |
| 8,212,836 | B2 | 7/2012 | Matsumoto et al. | |
| 8,297,783 | B2 | 10/2012 | Kim | |
| 8,331,099 | B2 | 12/2012 | Geissler et al. | |
| 8,337,029 | B2 | 12/2012 | Li | |
| 1,373,989 | A1 | 1/2013 | Mueller et al. | |
| 8,733,988 | B2 * | 5/2014 | Huang et al. | 362/421 |
| 2004/0052076 | A1 | 3/2004 | Mueller et al. | |
| 2006/0002108 | A1 | 1/2006 | Ouderkirk et al. | |
| 2006/0002110 | A1 | 1/2006 | Dowling et al. | |
| 2006/0164005 | A1 | 7/2006 | Sun | |
| 2006/0285193 | A1 | 12/2006 | Kimura et al. | |
| 2007/0013871 | A1 | 1/2007 | Marshall et al. | |
| 2007/0159492 | A1 | 7/2007 | Lo et al. | |
| 2007/0236931 | A1 * | 10/2007 | Chien | 362/250 |
| 2008/0002413 | A1 * | 1/2008 | Wang et al. | 362/341 |
| 2008/0143973 | A1 | 6/2008 | Wu | |
| 2008/0170398 | A1 * | 7/2008 | Kim | 362/260 |
| 2008/0198572 | A1 | 8/2008 | Medendorp | |
| 2008/0232084 | A1 | 9/2008 | Kon | |
| 2009/0059585 | A1 | 3/2009 | Chen et al. | |
| 2009/0128781 | A1 | 5/2009 | Li | |
| 2009/0141506 | A1 | 6/2009 | Lan et al. | |
| 2009/0237934 | A1 * | 9/2009 | Zeng et al. | 362/249.03 |
| 2009/0243495 | A1 * | 10/2009 | Levine | 315/153 |
| 2010/0006762 | A1 | 1/2010 | Yoshida et al. | |
| 2010/0202129 | A1 | 8/2010 | Abu-Ageel | |
| 2010/0231863 | A1 | 9/2010 | Hikmet et al. | |
| 2010/0238672 | A1 * | 9/2010 | Wu et al. | 362/373 |
| 2010/0244700 | A1 | 9/2010 | Chong et al. | |
| 2010/0315320 | A1 | 12/2010 | Yoshida | |
| 2010/0320928 | A1 | 12/2010 | Kaihotsu et al. | |
| 2010/0321641 | A1 | 12/2010 | Van Der Lubbe | |
| 2010/0328952 | A1 * | 12/2010 | Chen | F21V 17/02 362/249.05 |
| 2011/0116266 | A1 * | 5/2011 | Kim | 362/249.02 |
| 2011/0241529 | A1 * | 10/2011 | Matsui et al. | 313/318.01 |
| 2011/0310446 | A1 | 12/2011 | Komatsu | |
| 2012/0106154 | A1 * | 5/2012 | Chang | A47G 23/0216 362/249.02 |
| 2012/0127734 | A1 * | 5/2012 | Tanimoto et al. | 362/363 |
| 2012/0262921 | A1 | 10/2012 | Boomgaarden et al. | |
| 2012/0286700 | A1 | 11/2012 | Maxik et al. | |
| 2012/0315071 | A1 | 12/2012 | Saito | |
| 2013/0010470 | A1 * | 1/2013 | Min et al. | 362/238 |
| 2013/0021795 | A1 * | 1/2013 | Chien | 362/235 |
| 2013/0083547 | A1 * | 4/2013 | Lui | 362/382 |
| 2013/0114241 | A1 | 5/2013 | Van de Ven et al. | |
| 2013/0155672 | A1 * | 6/2013 | Vo et al. | 362/233 |
| 2014/0029262 | A1 * | 1/2014 | Maxik | F21V 21/14 362/272 |

FOREIGN PATENT DOCUMENTS

| | | |
|---|---|---|
| WO | WO 2008137732 | 11/2008 |
| WO | WO 2009/121539 A1 | 10/2009 |
| WO | WO 2012/158665 | 11/2012 |

OTHER PUBLICATIONS

United States Patent and Trademake Office's Non-Final Office Action dated Nov. 19, 2015 for related U.S. Appl. No. 14/087,338, filed Nov. 22, 2013.

United States Patent and Trademake Office's Interview Summary dated Feb. 8, 2016 for related U.S. Appl. No. 14/087,338, filed Nov. 22, 2013.

* cited by examiner

ROTATABLE LIGHTING DEVICE

RELATED APPLICATIONS

This application is related to U.S. patent application Ser. No. 13/765,256 titled Rotatable Lighting Fixture filed Feb. 12, 2013 which, in turn, claims the benefit under 35 U.S.C. §119(e) of U.S. Provisional Patent Application Ser. No. 61/643,312 titled Rotatable Lighting Fixture filed May 6, 2012, the entire contents of each of which are incorporated herein by reference. This application is also related to U.S. patent application Ser. No. 13/739,893 titled Tunable Lighting Apparatus filed Jan. 11, 2013, and U.S. Provisional Patent Application Ser. No. 61/715,075 filed on Oct. 17, 2012 titled Lighting Device with Integrally Molded Cooling System and Associated Methods the entire contents of each are incorporated herein by reference.

FIELD OF THE INVENTION

The present invention relates to the fields of lighting devices and, more specifically, to canister light fixtures and lighting devices that are rotatable and emit light in different beam angles and amounts, and associated methods.

BACKGROUND OF THE INVENTION

The majority of lighting devices are fixed, meaning they cannot be adjusted to direct light emitted by the lighting device, thus changing the area illuminated. Of those lighting devices that can be adjusted, many require a user to manually move components of the lighting device to direct the lighting device, thus changing the area illuminated. There are some lighting fixtures that permit mechanized adjustment of the direction of the lighting device, but many of those mechanized devices are limited in their range of motion and often occupy large volumes. Accordingly, there is a long felt need for a lighting fixture that will matingly engage with existing fixtures and permits a wide range of motion to direct light while not occupying an inordinate volume of space.

Lighting technologies such as light-emitting diodes (LEDs) offer significant advantages over incandescent and fluorescent lamps. These advantages include, but are not limited to, better lighting quality, longer operating life, and lower energy consumption. The majority of LED lighting devices include LEDs that are configured together on a single plane or on a single board and emit light in one beam angle. There are some lighting devices that permit light to be emitted in more than one beam angle, but many of those devices are limited in the amount of light they emit. Accordingly, there is a long felt need for a lighting device that emits light in multiple beam angles and where the amount of light emitted is not as limited.

U.S. Pat. No. 8,172,436 to Coleman et al. discloses an LED lighting assembly that rotates by means of a pivot post and base system. The lighting assembly does not include more than one means of rotation, however, and it does not include LEDs on multiple planes which may allow light to be emitted in multiple beam angles and in various amounts. Furthermore, the lighting assembly does not have a base that allows it to matingly engage with a light fixture or socket.

U.S. Pat. No. 7,618,150 to Tseng-Lu Chien discloses an LED lighting device that includes an adjustable angle function and includes multiple LED units. This device allows light to be emitted at varied beam angles, but may not allow for an increase or a decrease in the amount of light emitted and may not be rotational about any axis or multiple axes.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

In view of the foregoing, it is therefore an object of the present invention to provide an improved LED-based lamp for use in a space-limited lamp enclosure, such as a can light fixture. The embodiments of the present invention are related to a lighting device that advantageously allows for emission of light in a number of directions or angles and with varied amounts of light. The lighting device according to an embodiment of the present invention also advantageously provides ease of installation.

With the above in mind, the present invention is directed to a lighting device that includes an outer body having a base, a medial portion, and an upper portion. The lighting device also includes a light source carrying assembly adapted to carry a light source. The light source carrying assembly may include an assembly base that is carried by the medial portion of the outer body. The light source carrying assembly may also include an assembly top comprising a bottom portion, sidewalls, and a top portion. The bottom portion of the assembly top may include an assembly base connector member that pivotally engages a portion of the assembly base. The light source carrying assembly may further include a heat sink that matingly engages a portion of the assembly top. The lighting device may still further include a lens carried by the assembly top.

The light source carrying assembly may be configured to rotate about a first rotational axis defined by a vertical axis of the lighting device that passes through a medial portion of the base of the outer body. The light source carrying assembly may further be configured to pivot about a second rotational axis defined by a horizontal axis passing through a medial portion of the assembly base connector member of the assembly top. Additionally, the first and second rotational axes may be about perpendicular to one another.

A rotation mechanism may be configured to rotate the light source carrying assembly about at least one of the first and second axes. The rotation mechanism may be a first rotation mechanism configured to rotate the light source carrying assembly about the first rotational axis, and a second rotation mechanism configured to rotate the light source carrying member about the second rotational axis. The first and second rotation mechanisms may be an AC motor, a DC motor, an electrostatic motor, a servo motor, a stepper motor, an actuator, a hydraulic motor, a pneumatic motor, an electromagnet, or a permanent magnet.

The light source may be positionable such that light emitted by the light source propagates substantially below a plane defined by a surface portion of the upper portion of the outer body. According to an embodiment of the present invention, a second light source may be carried by the outer body or the light source carrying assembly. The light source may be configured to emit light within a first or a second beam angle, and the second light source may be configured to emit light within the second beam angle. The lighting device may include a channeling device so that the light emitted from the second light source may be directed to the lens.

The base of the outer body may be an Edison base, a bayonet base, a double contact bayonet base, a bi-pin, a bi-post, a wedge, or a GU10 turn and lock base. The light source may comprise a light emitting diode (LED).

DETAILED DESCRIPTION OF THE PREFERRED EMBODIMENT

Figure 1:
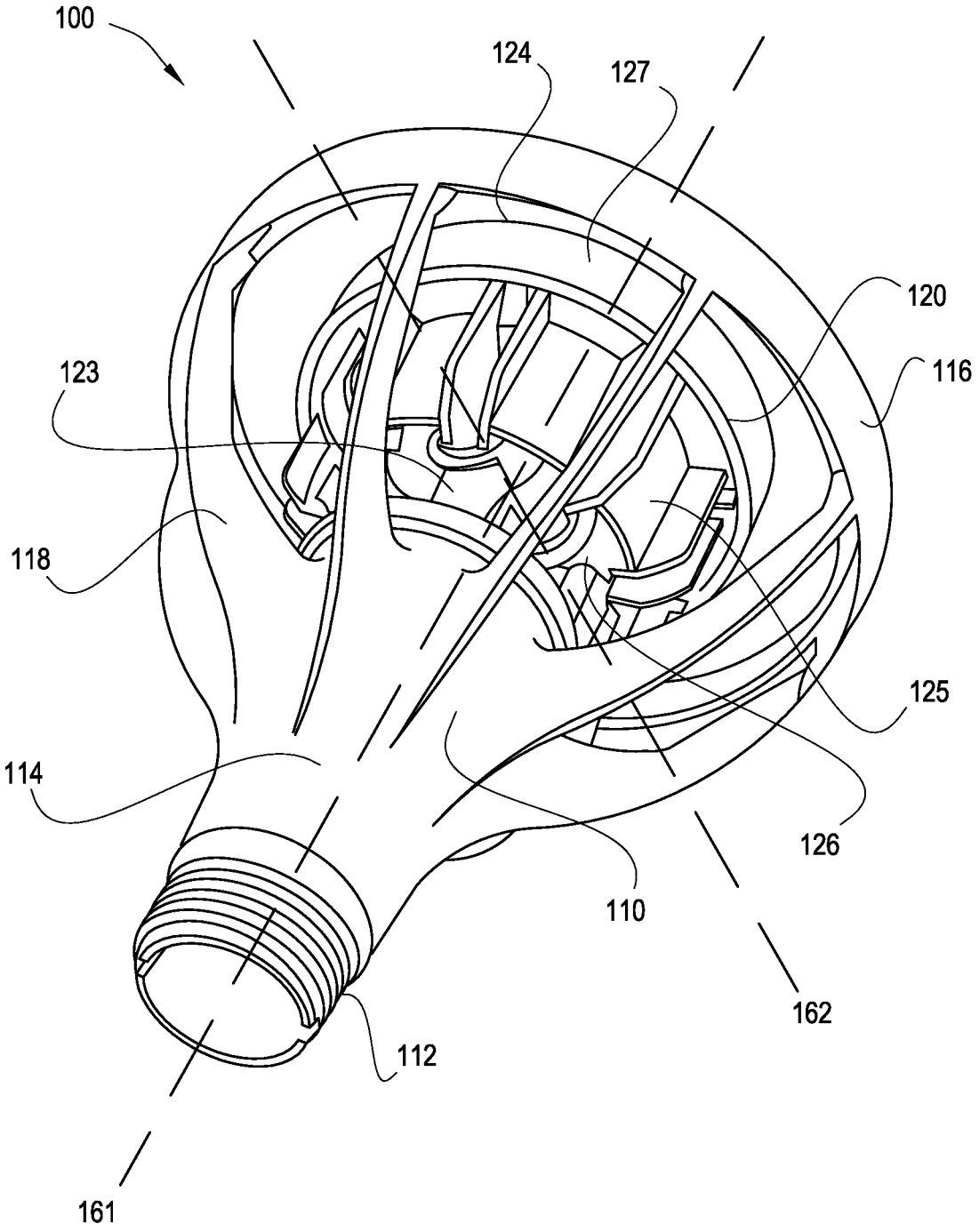
FIG. 1 is a perspective view of a lighting device according to an embodiment of the present invention.

The present invention will now be described fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art will realize that the following embodiments of the present invention are only illustrative and are not intended to be limiting in any way. Other embodiments of the present invention will readily suggest themselves to such skilled persons having the benefit of this disclosure. Additionally, like numbers refer to like elements throughout.

Throughout this disclosure, the present invention may be referred to as relating to luminaires, digital lighting, and light-emitting diodes (LEDs). Those skilled in the art will appreciate that this terminology is only illustrative and does not affect the scope of the invention. For instance, the present invention may just as easily relate to lasers or other digital lighting technologies. Additionally, a person of skill in the art will appreciate that the use of LEDs within this disclosure is not intended to be limited to any specific form of LED, and should be read to apply to light emitting semiconductors in general. Accordingly, skilled artisans should not view the following disclosure as limited to any particular light emitting semiconductor device, and should read the following disclosure broadly with respect to the same.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention. The terms pivot and rotation are often used interchangeably and should not be considered limiting in any way. Those skilled in the art will appreciate that many variations and alterations to the descriptions contained herein are within the scope of the invention.

Referring to FIGS. 1-6, a lighting device 100 according to an embodiment of the present invention, is now described in detail. Throughout this disclosure, the present invention may be referred to as a lighting device 100, a lighting system, an LED lighting system, a lamp system, a lamp, a luminaire, a device, a system, a product, and a method. Those skilled in the art will appreciate that this terminology is only illustrative and does not affect the scope of the invention.

According to an embodiment of the present invention, as depicted, for example, in FIGS. 1-3B, the lighting device 100 may include an outer body 110, a light source carrying assembly 120, a lens 130, and a driver circuit 141. The lighting device 100 may further include a second driver circuit 142, a communication device 143, a channeling device 150, and a rotation mechanism 170. The outer body 110 may include a base 112, a medial portion 114, an upper portion 116, and a plurality of ribs 118. The plurality of ribs 118 may provide support for the lighting device 100 and may carry the channeling device 150 as described herein.

Figure 4:
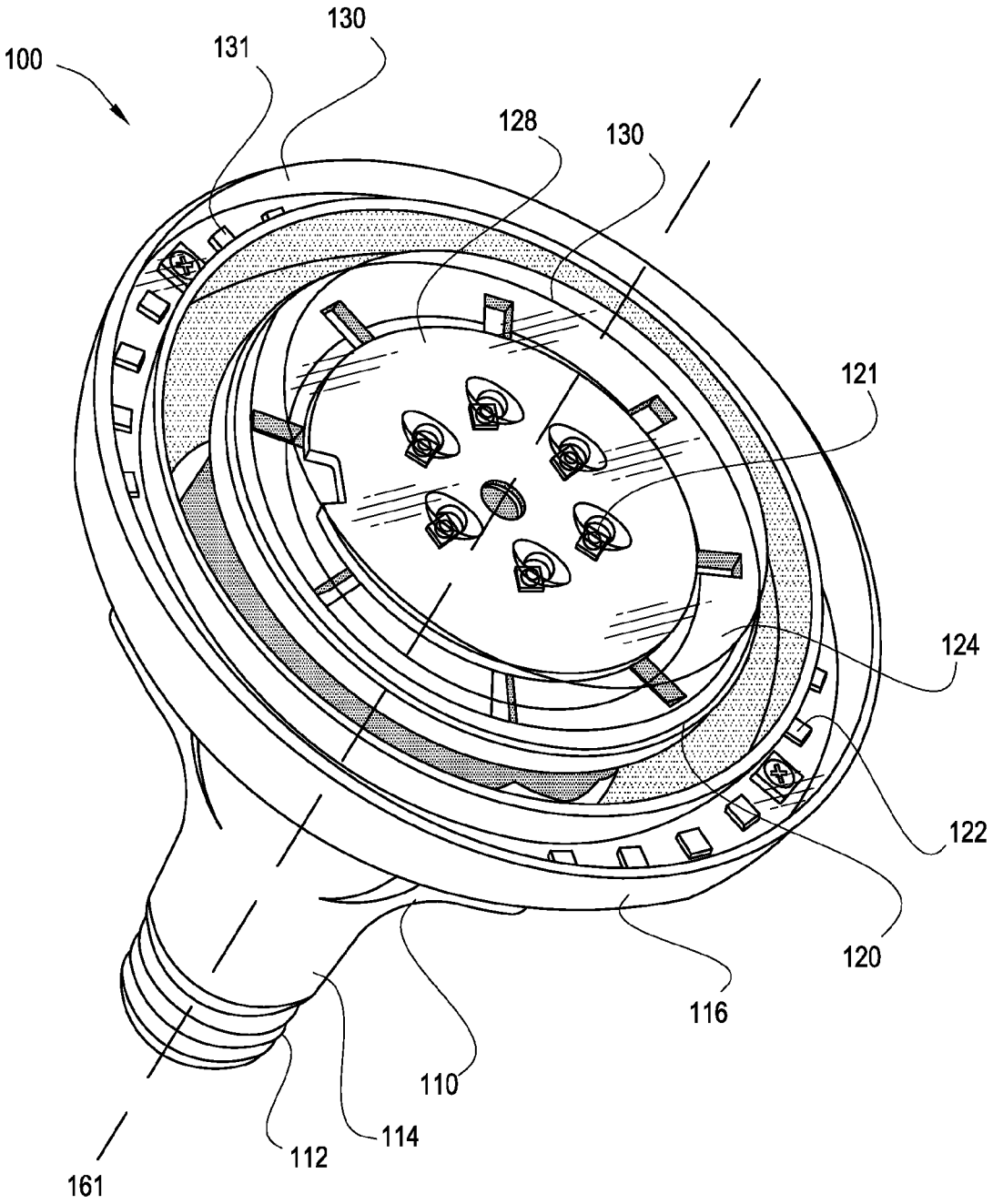
FIG. 4 is a perspective view of a lighting device according to another embodiment of the present invention.
Figure 5:
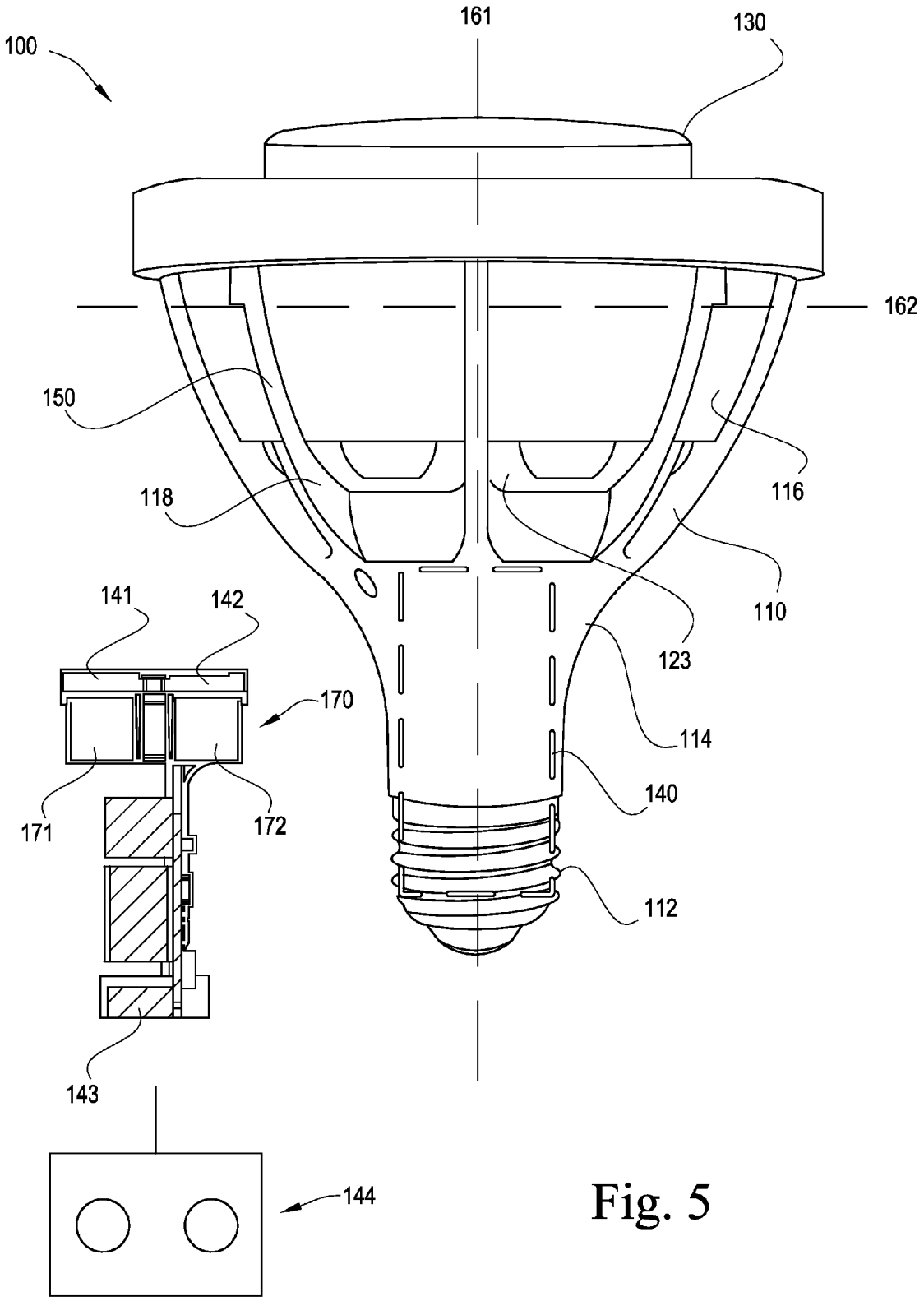
FIG. 5 is a side elevation schematic view of the lighting device illustrated in FIG. 4.
Figure 6:
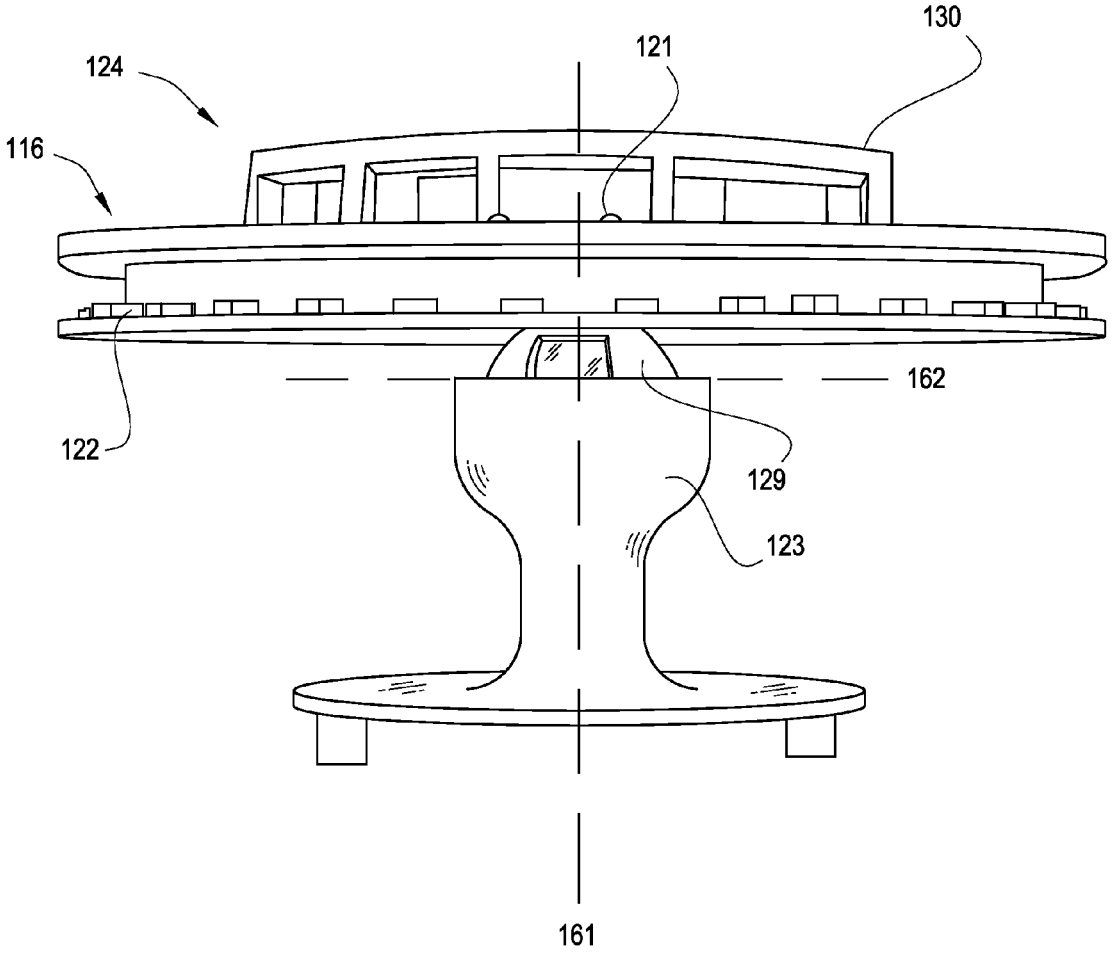
FIG. 6 is a side elevation view of a portion of the lighting device illustrated in FIG. 4.

The light source 121 (as well as the second light source 122, which is only present in an alternate embodiment of the invention, as illustrated, for example, in FIGS. 4-6) may be carried by the outer body 110 or the light source carrying assembly 120. The second light source 122, illustrated, for example, in FIG. 4, may be positioned generally closer to the base 112 relative to the light source 121. The second light source 122 may also be carried by the outer body 110 or the light source carrying assembly 120 and be positioned generally closer to the base 112 relative to the light source 121 and the light emitted by the second light source 122 may be guided, directed, redirected, channeled, or moved by the channeling device 150 to the upper portion 116 or the assembly top 124. The second light source 122 may also be positioned in a generally annularly formation about the light source 121 or along the upper portion 116. In some embodiments, the upper portion 116 and/or the assembly top 124 may include a diffusing element. In other words, in the preferred embodiment of the invention, the light source 121 may be positioned along a centrally positioned portion of the lighting device 100, and the second light source 122 may be positioned along the circumference, or an outer peripheral portion, of the outer body 110 of the lighting device 100. Those skilled in the art will readily appreciate that the configuration of the light source 121 and the second light source 122 may be any configuration, and that the configurations described above are exemplary configurations, and not meant to be limiting in any way.

The light source carrying assembly 120 may comprise an assembly base 123, an assembly top 124, and a heat sink 125. The assembly base 123 may be carried by the medial portion 114 of the outer body 110. The assembly top 124 may comprise a bottom portion 126, sidewalls 127, and a top portion 128. The bottom portion 126 may include an assembly base connector member 129 that pivotally or rotationally engages a portion of the assembly base 123. The lighting device 100 may include one or more heat sinks 125, and portions of the heat sink 125 may include fins. The light source 121 and the second light source 122 may emit light which may produce heat. The heat sink 125 may provide surface area to allow heat to travel away from the light source 121 and the second light source 122, thereby cooling the light source 121 and the second light source 122. Removing heat from the light source 121 and the second light source 122 may enhance the life of the light source 121, the second light source 122, and the lighting device 100 in general.

The heat sink 125 may be configured to extend substantially the length of the outer body and the fins may be configured to extend substantially the length of the heat sink 125. Those skilled in the art will appreciate that the present invention contemplates the use of fins that extend any distance and may project radially outward from the heat sink 125, and that the disclosed heat sink 125 that includes fins that extend substantially the length thereof is not meant to be limiting in any way. The fins may increase the surface area of the heat sink 125 and may permit thermal fluid flow between each fin, thereby enhancing the cooling capability of the heat sink 125. The plurality of ribs 118 may also allow additional thermal fluid flow between each rib 118, thereby enhancing the cooling capability of the heat sink 125. Additional details and information regarding the cooling function of heat sinks with respect to lighting devices are provided in U.S. Provisional Patent Application Ser. No. 61/715,075 titled Lighting Device with Integrally Molded Cooling System and Associated Methods filed on Oct. 17, 2012

The lens 130 may attach to either the outer body 110, the upper portion 116, the assembly top 124, and/or the top portion 128. Specifically, the lens 130 may form an interference fit with the outer body 110, the upper portion 116, the assembly top 124, and/or the top portion 128. The interference fit preferably provides sufficient strength to carry the lens 130. Optionally, the lens 130 may be attached to the outer body 110, the upper portion 116, the assembly top 124, and/or the top portion 128 through the use of an adhesive, glue, or any other attachment method known in the art.

Referring to FIGS. 2 and 4-6, the lens 130 may be configured to interact with light emitted by the light source 121 and/or the second light source 122 to refract, reflect, or otherwise redirect incident light. Accordingly, the light source 121 and/or the second light source 122 may be disposed such that light emitted therefrom is incident upon the lens 130. The lens 130 may be formed in any shape to impart a desired refraction. In the present embodiment, the lens 130 has a generally flat geometry. Furthermore, the lens 130 may be formed of any material with transparent or translucent properties that comport with the desired refraction to be performed by the lens 130. The lighting device 100 may include multiple lenses 130. In some embodiments of the lighting device 100, a secondary lens 131 can be included and may attach to either the outer body 110, the upper portion 116, the assembly top 124, and/or the top portion 128. The secondary lens 131 may be configured to interact with light emitted by the second light source 122 to refract, reflect, or otherwise redirect incident light.

The light source 121 and the second light source 122 may include any device capable of emitting light. The light source 121 and the light source 122 may, for example and without limitation, include incandescent lights, halogens, fluorescents (including compact-fluorescents), high-intensity discharges, light emitting semiconductors, such as light-emitting diodes (LEDs), lasers, and any other light-emitting device known in the art. In some embodiments of the present invention, the light source 121 and the second light source 122 are an LED package. In some further embodiments, the LED package may include a plurality of LEDs and a circuit board.

Figure 2:
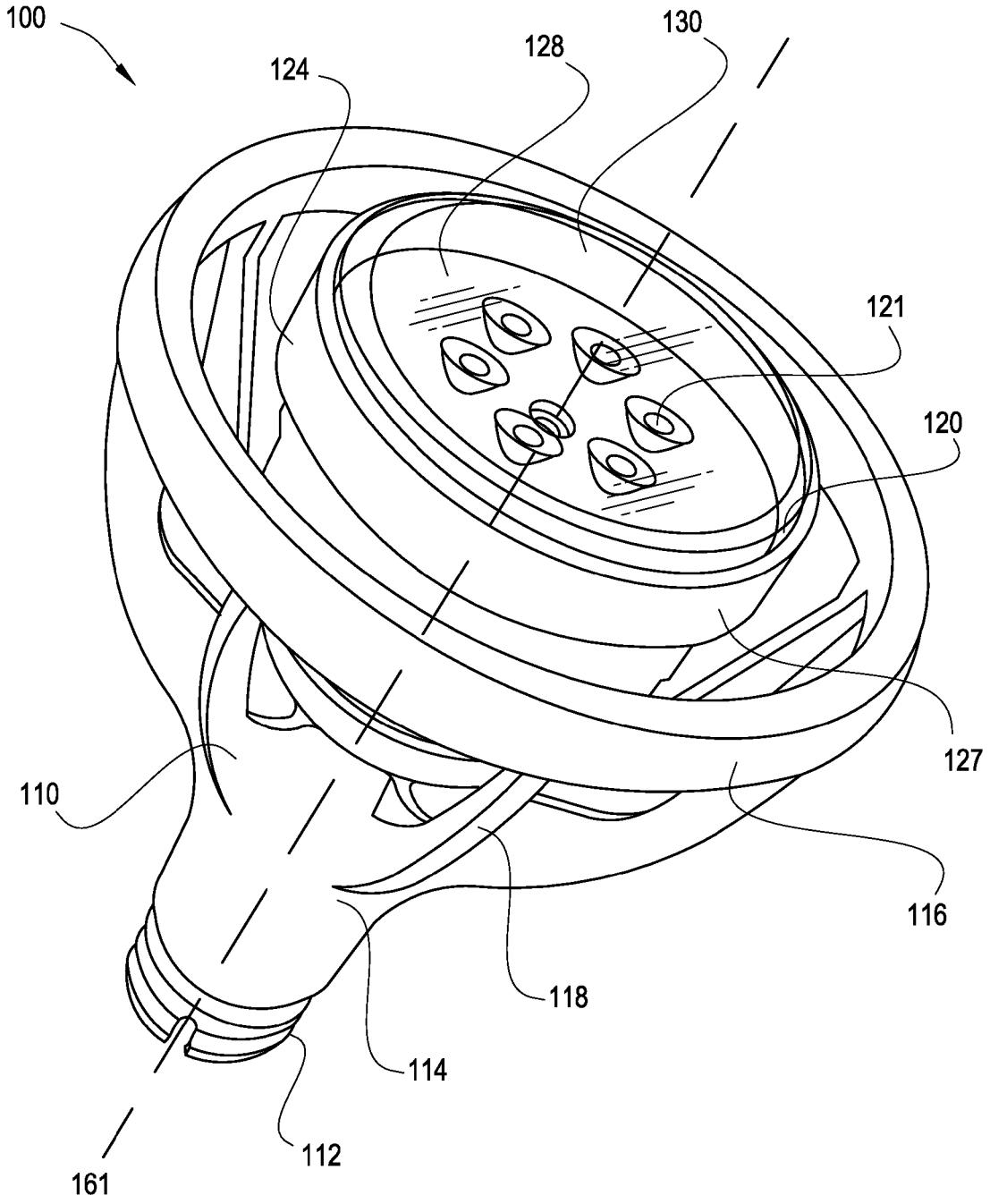
FIG. 2 is a perspective view of the lighting device illustrated in FIG. 1.
Figure 3A:
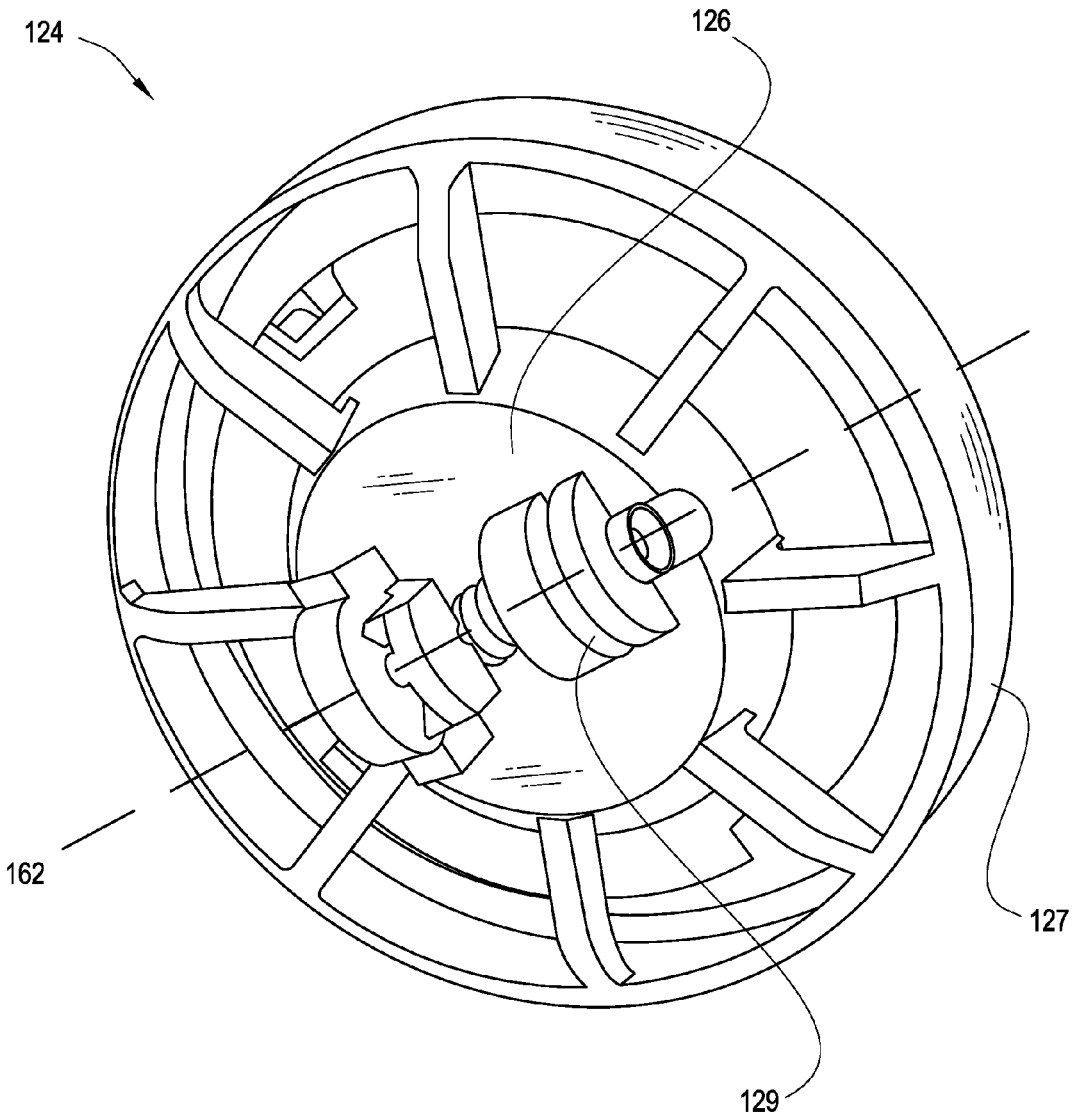
FIG. 3A is a perspective view of a portion of the lighting device illustrated in FIG. 1.
Figure 3B:
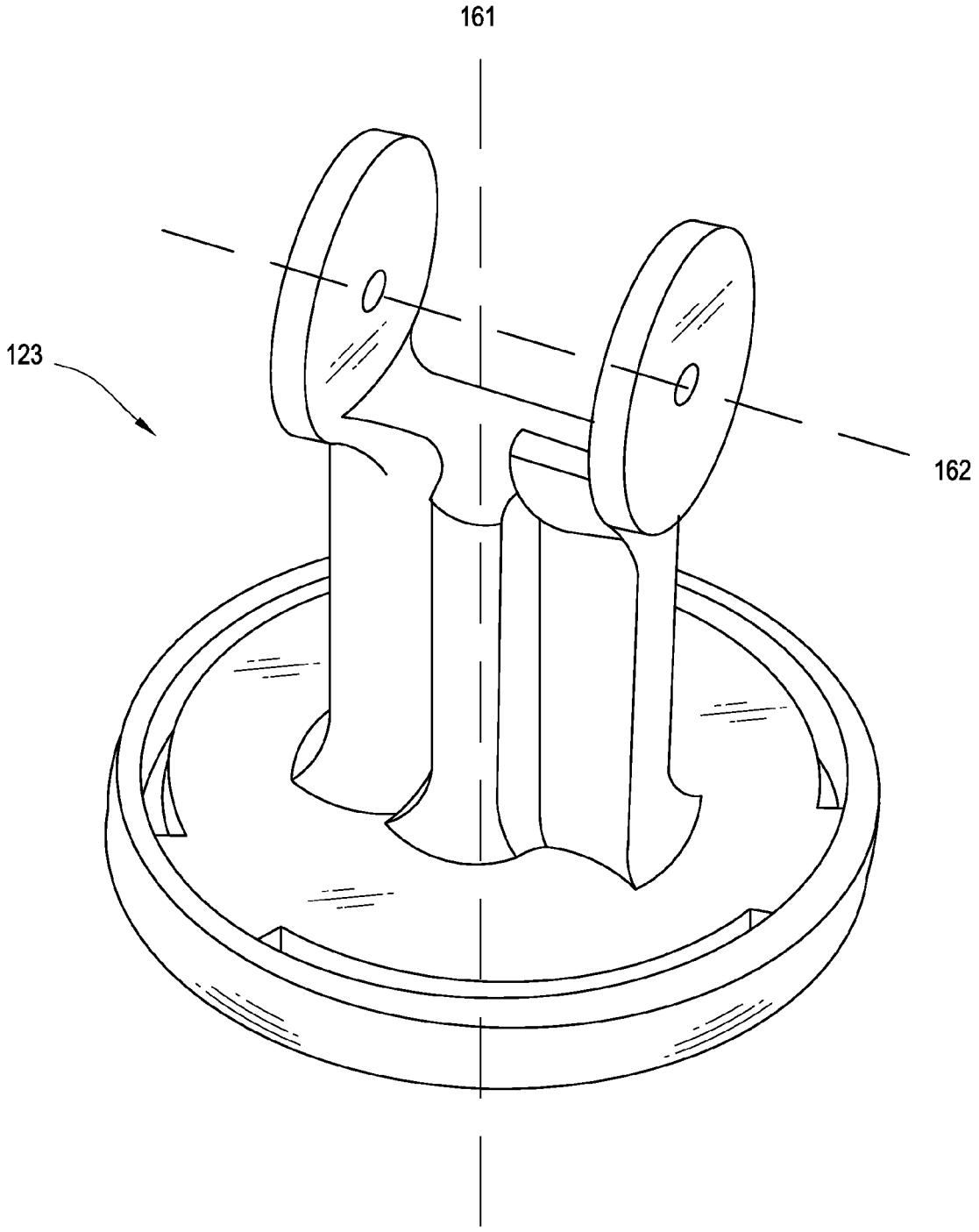
FIG. 3B is a perspective view of a portion of the lighting device illustrated in FIG. 1.

Referring now to FIGS. 1, 2, and 5, the heat sink 125 may matingly engage a portion of the assembly top 124. The driver circuit 141 may be electrically coupled to at least one of the light source 121, the second light source 122, and the base 112. The second driver circuit 142 may be electrically coupled to the second light source 122, the driver circuit 141, and/or the communication device 143. The communication device 143 may be electrically coupled to the driver circuit 141, the second driver circuit 142, and/or the rotation mechanism 170. The communication device 143 may be a wireless communication device. The communication device 143 may be a radio device, a computer network device, a visible light device, an acoustic device, or any other device known in the art that provides wireless communication. Those skilled in the art will appreciate that a communication device 143 being incorporated into the lighting device 100 advantageously allows for the lighting device 100 to be remotely operated and/or monitored, if so desired by a user. As illustrated in FIG. 5, for example, a remote control 144 may be used to rotate and/or pivot the lighting device 100. The remote control 144 may also be used to adjust the amount and the beam angle of the light emitted from the light source 121 and/or the second light source 122. Additional details relating to communication devices incorporated into a lighting device are provided in U.S. patent application Ser. No. 12/145,634 titled Configurable Environmental Condition Sensing Luminaire System and Associated Methods filed on Feb. 23, 2012, which, in turn, claims the benefit of U.S. Provisional Patent Application Ser. No. 61/486,316 titled Motion Detecting Security Light and Associated Methods filed on May 15, 2011, as well as U.S. Provisional Patent Application Ser. No. 61/486,314 titled Wireless Lighting Device and Associated Methods filed on May 15, 2011, and U.S. Provisional Patent Application Ser. No. 61/486,322 titled Variable Load Power Supply filed on May 15, 2011, the entire contents of each of which are incorporated by reference.

Referring now to FIGS. 1-6, the light source carrying assembly 120 may be configured to rotate about a first rotational axis 161 defined by a vertical axis of the lighting device 100 that passes through a centrally positioned portion of the base 112 of the outer body 110. The first rotational axis 161 is illustratively drawn as a dashed line in FIGS. 1, 2, 3B, 4, 5, and 6. More specifically, the first rotational axis 161 preferably longitudinally passes through the centrally positioned portion of the lighting device. As perhaps best illustrated, for example, in FIG. 4, the first rotational axis 161 may be centrally located between the light source 121. Although the first rotational axis 161 is displayed as centrally passing between the plurality of LEDs that make up the light source 121, those skilled in the art will readily appreciate that this is simply exemplary in nature, and the first rotational axis 161 may be positioned anywhere on the lighting device 100 that allows for the light source carrying assembly 120 to be rotated as described herein.

The light source carrying assembly 120 may be further configured to pivot about a second rotational axis 162 defined by a horizontal axis passing through a centrally positioned portion of the assembly base connector member 129 of the assembly top 124. The second rotational axis 162 is perhaps best illustrated in FIGS. 1, 3A, 3B, 5, and 6. More specifically, the second rotational axis 162 preferably latitudinally passes through a medial portion of the assembly base connector 129 (which is discussed in greater detail below) to advantageously allow the lighting device 100 to be pivotally positioned about the second rotational axis 162. Although the second rotational axis 162 is displayed as centrally passing through the assembly base connector 129, those skilled in the art will readily appreciate that this is simply exemplary in nature, and the second rotational axis 162 may be positioned anywhere on the lighting device 100 that allows for the light source 121 and the second light source 122 to be readily pivoted as may be desired by a user.

The first and second rotational axes 161, 162 may be perpendicular to one another. In noting, however, that the first and second rotational axes 161, 162 may be perpendicular to one another, those skilled in the art will appreciate that the first and second rotational axes 161, 162 may be substantially perpendicular to one another while still accomplishing the goals, features and objectives according to the present invention. The configuration of the first and second rotational axes 161, 162 allows for the lighting device 100 of the present invention to readily rotate and pivot so that light emitted from the light source 121 and the second light source 122 propagates substantially below a plane defined by a surface portion of the upper portion 116 of the outer body 110. More particularly, and by way of example, light emitted from the light source 121 and the second light source 122 may be emitted in a lower hemisphere, i.e., substantially below a plane formed by an end portion of the outer body 110. In the figures, the end portion of the outer body 110 is considered the annularly shaped portion adjacent the light source 121. Those skilled in the art will appreciate, however, that the light emitted by the light source 121 and the second light source 122 may be emitted below any plane as defined during construction of the lighting device 100 and in any direction due to the configuration of the first and second rotational axes 161, 162.

Although it is preferable for the light from the light source 121 and the second light source 122 to be emitted in a generally downward direction, i.e., in a direction opposite the base, those skilled in the art will appreciate that the light may shine outwardly from the light source carrying assembly 120 in an opposite direction through various openings, and also continue to emit through the openings formed in the outer body 110. This may advantageously allow for the lighting device 100 according to embodiments of the present invention to provide various lighting effects that may be desirable to a user.

In one embodiment of the invention, the assembly base 123 may be configured to rotate about the first rotational axis 161 resulting in the rotation of the light source carrying assembly 120. The assembly base connector member 129 may be configured to pivotally engage the assembly base 123 resulting in the pivoting of the light source carrying assembly 120.

As perhaps best illustrated in FIGS. 1, 3A, 3B, 5, and 6, in another embodiment of the invention, the assembly base 123 may be attached to the outer body 110. The assembly base connector member 129 may be configured to rotate and/or pivot about the first and second rotational axes 161, 162 resulting in the rotating and/or pivoting of the light source carrying assembly 120.

As illustrated in FIGS. 1-6, the rotation mechanism may be configured to rotate the light source carrying assembly 120 about either or both of the first and second rotational axes 161, 162. The rotation mechanism 170 may be provided by a first rotation mechanism 171 and a second rotation mechanism 172. The first rotation mechanism 171 may be configured to rotate the light source carrying assembly 120 about the first rotational axis 161. The second rotation mechanism 172 may be configured to pivot the light source carrying member 120 about the second rotational axis 162. The rotation mechanism 170 and the first and second rotation mechanisms 171, 172 may be provided by an AC motor, a DC motor, an electrostatic motor, a servo motor, a stepper motor, an actuator, a hydraulic motor, a pneumatic motor, an electromagnet, and/or a permanent magnet. The skilled artisan will appreciate that any device suitable to cause rotation and pivoting about the first and second rotational axes 161, 162 may be used as the rotation mechanism 170 and the first and second rotation mechanisms 171, 172, without limitation. The first and second rotation mechanisms 171, 172 may be provided by the same or different devices and may also include any other device that may impart a rotational, pivotal, or other similar action on the light source carrying member 120.

As indicated above, and with reference to FIGS. 1, 2, 4, 5, and 6, the light source 121 may be positionable such that light emitted by the light source 121 propagates substantially below a plane defined by a surface portion of the upper portion 116 of the outer body 110. The light source 121 may be configured to emit light in at least one of a first and second beam angle. The second light source 122 may also be configured to emit light in at least one of the first and second beam angle. The channeling device 150 of the lighting device 100 according to an embodiment of the present invention may direct light emitted from the second light source 122 to the lens 130 so as not to be incident upon the light source 121. The channeling device may be carried by the plurality of ribs 118. The channeling device 150 may be configured to direct light emitted by the second light source 122 to an area adjacent an outer edge of the light source 121. The channeling device 150 may also be configured to direct light emitted by the second light source 122 so as to be emitted generally annularly about the light source 121. Those skilled in the art will appreciate that the channeling device 150 may be any structure that can guide, direct, redirect, channel, or move light, such as a light guide, and may be in any shape, location, or configuration, and that the configurations described above are exemplary configurations, and not meant to be limiting in any way.

Referring to FIGS. 4 and 6, light emitted from the light source 121 and the second light source 122 may combine to form a combined light. The combined light may have a center beam and a gradient and the center beam may have a greater brightness than the gradient. Additional information regarding combining light to form a combined light is found in U.S. patent application Ser. No. 13/107,928, the entire contents of which are incorporated herein by reference.

Additionally, those skilled in the art will appreciate that there may be any number of light sources which may be positioned on any number of planes, above or below each other relative to the base 112. These light sources may also emit light in any number of beam angles and combine light in any number of combinations that may increase or decrease the brightness of the center beam or gradient.

Referring now to FIGS. 1, 2, 4, and 5, those skilled in the art will appreciate that although the base 112 is illustrated as being an Edison connector attached to the outer body 110 of the lighting device 100, the base 112 for the lighting device 100 may be provided by any type of connector that is suitable for connecting the lighting device to an external power source, including, but not limited to an Edison base, a bayonet base, a double contact bayonet base, a bi-pin, a bi-post, a wedge, and a GU10 turn and lock base.

Referring to FIGS. 1, 3A, 3B, and 6, those skilled in the art will appreciate that although the assembly base 123 is illustrated as being at least one of a pivot joint, a ball and socket joint, and a rotational joint, the connection between the outer body 110 and the light source carrying assembly 120 may be provided by any means available in the art and by one or more connections. Specifically, the connection may be provided by a pivot joint, a ball and socket joint, a rotational joint, a knuckle joint, a turnbuckle, and/or a pin joint, but any joint known in the art may be used.

As illustrated in FIGS. 1-3B, in one embodiment, the assembly base 123 may be connected to the medial portion 114 of the outer body 110 by a rotational joint providing rotation of the assembly base 123 and the light source carrying assembly 120 in 360 degrees about the first rotational axis 161. Additionally, the assembly base 123 may be connected to the assembly base connector member 129 by a pivot joint providing up to 180 degrees of pivot of the light source carrying assembly 120 about the second rotational axis 162.

As illustrated in FIGS. 4-6, in another embodiment, the assembly base 123 and the assembly base connector member 129 may be connected by a ball and socket joint. This may provide 360 degrees of rotation of the light source carrying assembly 120 about the first rotational axis 161 and about 180 degrees of pivot of the light source carrying assembly 120 about the second rotational axis 162. This configuration advantageously allows for light emitted from the light source 121 and the second light source 122 to be readily directed as described above.

Referring again to FIGS. 1, 2, 4, and 5, for example, and without limitation, the outer body 110 may be formed into any tubular shape, including a circle, ovoid, square, rectangle, triangle, or any other polygon. Referring to an embodiment of the lighting device 100, the outer body 110 may be substantially hollow to form a circuitry chamber 140, although not shown because it is internal to the structure, for the sake of clarity, it is shown schematically drawn in FIG. 5 with the dashed line indicating merely that it is carried by a portion of the outer body 110, and not necessarily indicating the location of the circuitry chamber 140 or the components within. The circuitry chamber 140 may be configured to permit a power supply and electronic control devices to be positioned therewithin. The power supply may be configured to include an electrical contact and at least one of the driver circuit 141 and the second driver circuit 142. The circuitry chamber 140 may present a void of sufficient geometry to permit electrical connectors, such as wires, to pass therethrough from at least one of the light source 121 and the second light source 122 to the base 112. In order to maintain a fluid seal between the circuitry chamber 140 and the environment external to the lighting device 100, the outer body 110 may further include a sealing member. The sealing member may include any device or material that can provide a fluid seal as described above. For example, and without limitation, the sealing member may form a fluid seal between the outer body 110 and the base 112. Other embodiments may have the circuitry chamber 140 disposed on other parts of a cooling system and the outer body 110.

Also for example, and without limitation, the outer body 110, the light source carrying assembly 120, components of the outer body 110, and components of the light source carrying assembly 120 may be at least one of molded and overmolded, which may be individually and separately, and which may be accomplished by any molding process known in the art, including, but not limited to blow molding, sintering, compression molding, extrusion molding, injection molding, matrix molding, transfer molding, and thermoforming. The outer body 110, the light source carrying assembly 120, components of the outer body 110, and components of the light source carrying assembly 120 may be attached by glue, adhesives, fasteners, screws, bolts, welding, or any other means known in the art. The power supply and other electronic circuitry may be installed into the circuitry chamber 140 of the body 110. The power supply may include at least one of an electrical contact, the driver circuit 141, and the second driver circuit 142.

Additionally, and without limitation, at least one of the outer body 110, the light source carrying assembly 120, components of the outer body 110, and components of the light source carrying assembly 120 may be provided by a material having a thermal conductivity=150 Watts per meter-Kelvin, a material having a thermal conductivity=200 Watts per meter-Kelvin, aluminum, an aluminum alloy, a magnesium alloy, a metal loaded plastics material, a carbon loaded plastics material, a thermally conducting ceramic material, an aluminum silicon carbide material, and a plastic.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus, the scope of the invention should be determined by the appended claims and their legal equivalents, and not by the examples given.

What is claimed is:

1. A lighting device comprising:

an outer body comprising a base, a medial portion, and an upper portion;

a light source carrying assembly carrying a rotatable first light source, the light source carrying assembly comprising;

an assembly base that is carried by the medial portion of the outer body, an assembly top comprising a bottom portion, sidewalls and a top portion, the bottom portion of the assembly top including an assembly base connector member that pivotally engages a portion of the assembly base, a heat sink that matingly engages a portion of the assembly top, and a lens carried by the assembly top; and a non-rotatable second light source carried by the outer body that is annularly o d around the rotatable first light source;

wherein the light source carrying assembly is configured to rotate in relation to the outer body about a first rotational axis defined by a vertical axis of the lighting device that passes through a medial portion of the base of the outer body;

wherein the light source carrying assembly and the first light source are configured to pivot about a second rotational axis defined by a horizontal axis passing through a medial portion of the assembly base connector member of the assembly top;

wherein the outer body generally circumscribes the light source carrying assembly; and wherein the first and second rotational axes are perpendicular to one another.

2. A lighting device according to claim 1 further comprising a rotation mechanism configured to rotate the light source carrying assembly about at least one of the first and second rotational axes.

3. A lighting device according to claim 2 wherein the rotation mechanism is a first rotation mechanism configured to rotate the light source carrying assembly about the first rotational axis, and a second rotation mechanism configured to rotate the light source carrying member about the second rotational axis.

4. A lighting device according to claim 3 wherein the first and second rotation mechanisms are selected from the group consisting of an AC motor, a DC motor, an electrostatic motor, a servo motor, a stepper motor, an actuator, a hydraulic motor, a pneumatic motor, an electromagnet, and a permanent magnet.

5. A lighting device according to claim 1 wherein the light source is positionable such that light emitted by the light source propagates substantially below a plane defined by a surface portion of the upper portion of the outer body.

6. A lighting device according to claim 1 wherein the light source is configured to emit light in at least one of a first and second beam angle; and wherein the second light source is configured to emit light in the second beam angle.

7. A lighting device according to claim 1 further comprising a channeling device so that the light emitted from the second light source is directed to the lens.

8. A lighting device according to claim 1 wherein the base of the outer body is selected from the group consisting of an Edison base, a bayonet base, a double contact bayonet base, a bi-pin, a bi-post, a wedge, and a GU10 turn and lock base.

9. A lighting device according to claim 1 wherein the light source comprises a light emitting diode (LED).

10. A lighting device comprising:

a light source carrying assembly carrying a rotatable first light source, the light source carrying assembly comprising;

an assembly base, an assembly top that rotationally engages a portion of the assembly base, and an outer body generally circumscribing the light source carrying assembly and comprising a base, an upper portion, and a plurality of ribs and carrying a non-rotatable second light source carried by the outer body, that is annulary formed around the rotatable first light source;

a driver circuit; and a channeling device;

wherein the driver circuit is electrically coupled to at least one of the rotatable first light source, the non-rotatable second light source, and the base;

wherein the rotatable first light source is configured to emit light in at least one of a first and second beam angle;

wherein the second light source is configured to emit light in the second beam angle;

wherein the light generated from the second light source is directed to the lens by the channeling device, and wherein the plurality of ribs carries the channeling device.

11. A lighting device according to claim 10 wherein the second light source is carried by at least one of the outer body in a position generally towards the base relative to the light source and the light source carrying assembly adjacent the light source; and wherein the channeling device is configured to direct light emitted by the second light source so as not to be incident upon the light source.

12. A lighting device according to claim 10 wherein the channeling device is configured to direct light emitted by the second light source to an area adjacent an outer edge of the light source.

13. A lighting device according to claim 12 wherein the channeling device is configured to direct light emitted by the second light source so as to be emitted generally annularly about the light source.

14. A lighting device according to claim 10 wherein the light emitted by the light source and the second light source combines to form a combined light; wherein the combined light has a center beam and a gradient; and wherein the center beam has a greater brightness than the gradient.

15. A lighting device according to claim 10 further comprising a second driver circuit electrically coupled to at least one of the second light source, the driver circuit, and a communication device.

16. A lighting device according to claim 10 further comprising a communication device.

17. A lighting device according to claim 16 wherein the communication device is electrically coupled to at least one of the driver circuit and a rotation mechanism.

18. A lighting device according to claim 16 wherein the communication device is a wireless communication device.

19. A lighting device according to claim 16 wherein the communication device is selected from the group of communication devices consisting of radio devices, computer network devices, visible light devices, and acoustic devices.

* * * * *